US006848486B2

(12) United States Patent
Heikkinen

(10) Patent No.: US 6,848,486 B2
(45) Date of Patent: Feb. 1, 2005

(54) METHOD FOR PREPARING A DISC CHIPPER WEAR PLATE FOR REUSE AND A DISC CHIPPER WEAR PLATE PREPARED ACCORDING TO THE METHOD

(75) Inventor: Reima Heikkinen, Rauma (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/250,701

(22) PCT Filed: Jan. 25, 2002

(86) PCT No.: PCT/FI02/00059

§ 371 (c)(1),
(2), (4) Date: Aug. 27, 2003

(87) PCT Pub. No.: WO02/060663

PCT Pub. Date: Aug. 8, 2002

(65) Prior Publication Data

US 2004/0050453 A1 Mar. 18, 2004

(30) Foreign Application Priority Data

Feb. 2, 2001 (FI) ..... 20010201

(51) Int. Cl.[7] ..... B27L 11/00; B27M 3/00

(52) U.S. Cl. ..... 144/368; 144/373; 144/176

(58) Field of Search ..... 144/330, 344, 144/346, 348, 350, 373, 176, 218, 240, 241, 368; 241/92, 292.1, 293, 294, 296, 300

(56) References Cited

U.S. PATENT DOCUMENTS

| | | | | |
|---|---|---|---|---|
| 5,129,437 A | * | 7/1992 | Nettles et al. | 144/176 |
| 5,417,263 A | | 5/1995 | Jorgensen | |
| 5,857,508 A | * | 1/1999 | Jonkka | 144/363 |
| 6,056,030 A | | 5/2000 | Jonkka | |

* cited by examiner

*Primary Examiner*—Allen Ostrager
*Assistant Examiner*—Shelley Self
(74) *Attorney, Agent, or Firm*—Burns, Doane, Swecker & Mathis, LLP

(57) ABSTRACT

A method is provided for reconditioning after rehardfacing the wear plates that are used on the mounting face of the knife disc of a disc chipper so that the original dimensions of the wear plate are substantially restored. Also, a wear plate is provided which is reconditioned in accordance with the method. A rear side of the wear plates is machined to incorporate at least one additional groove and into the grooves made on the wear plate rear side are affixed machining allowance strips, whereupon the allowance strips can be machined as required to restore the thickness dimensions of the wear plate.

12 Claims, 5 Drawing Sheets

METHOD FOR PREPARING A DISC CHIPPER WEAR PLATE FOR REUSE AND A DISC CHIPPER WEAR PLATE PREPARED ACCORDING TO THE METHOD

FIELD OF THE INVENTION

The present invention relates to a method for preparing the wear plate of a disc chipper and a disc chipper wear plate reconditioned using the method.

BACKGROUND OF THE INVENTION

A disc chipper is commonly used in the paper and pulp industry for chipping wood for pulping. Aligned substantially radially on the knife disc of a disc chipper are mounted knives that against a stationary anvil knife cut wood into chips. The sectors remaining between the knives are covered with wear plates against which the wood to be chipped are fed. As the entering logs impose a continuous abrasion on the wear plates, they must be made sufficiently strong against continuous wear. A disc chipper and its wear plates is described in patent application publication WO 96/26817.

To make the machining of the wear plates easy, they are conventionally fabricated from a relatively soft steel grade and then coated with a wear-resistant material on their front side. The hardness and wear resistance properties of the coating are selected to be substantially higher than that of the wear plate base material, whereby the coating forms a stronger surface against wear. Conventionally, the coating is applied as a powder that is sprayed and melted (sintered) in a heat treatment process on the surface of the wear plate front side. The melting step takes place in an oven at a temperature in excess of 1000° C. During the heat treatment process, the wear plate blank typically undergoes an unpredictable amount of minor deformations. Hence, the uncoated surfaces of the wear plate are post-machined to correct dimensions only after the heat treatment.

Depending on the chipped quantity, species of wood and amount of impurities carried over therewith, hardfaced wear plates last 6 to 36 months of use. Certain tropical deciduous wood species in particular may reduce the life of hardfacing on the wear plate even shorter than six months.

Generally, a single knife disc may contain 10 to 16 wear plates. Since the replacement of wear plates with entirely new ones is relatively expensive, users of disc chippers strive to recondition outworn wear plates for reuse. A problem hampering rehardfacing is the deformation of wear plate dimensions due to the heat treatment required in the coating process. However, a wear plate to be reconditioned with a new hardcoating on its wear surface does not have any machining allowance for correcting dimensional errors. If shape deformations are machined away, the shape of the wear plate falls short of the acceptable minimum dimensions, whereby it cannot be used as a replacement in conjunction with new wear plates. Hence, all wear plates of a disc chipper must be replaced at the same time if reconditioned wear plates are installed. Furthermore, great care must be taken to avoid mixing reconditioned wear plates with new wear plates at any time.

SUMMARY OF THE INVENTION

Now, the method according to the present invention makes it possible to machine a reconditioned wear plate after the application of a new coating so that its crucial dimensions, particularly its thickness, is restored to its original values so that the reconditioned wear plate is fully equivalent to a new wear plate during replacement.

The method according to the invention is characterized by what is stated in the appended independent claims.

BRIEF DESCRIPTION OF THE DRAWINGS

Next, the invention will be examined in greater detail by making reference to the attached drawings, wherein.

DETAILED DESCRIPTION OF THE INVENTION

Figure 1:
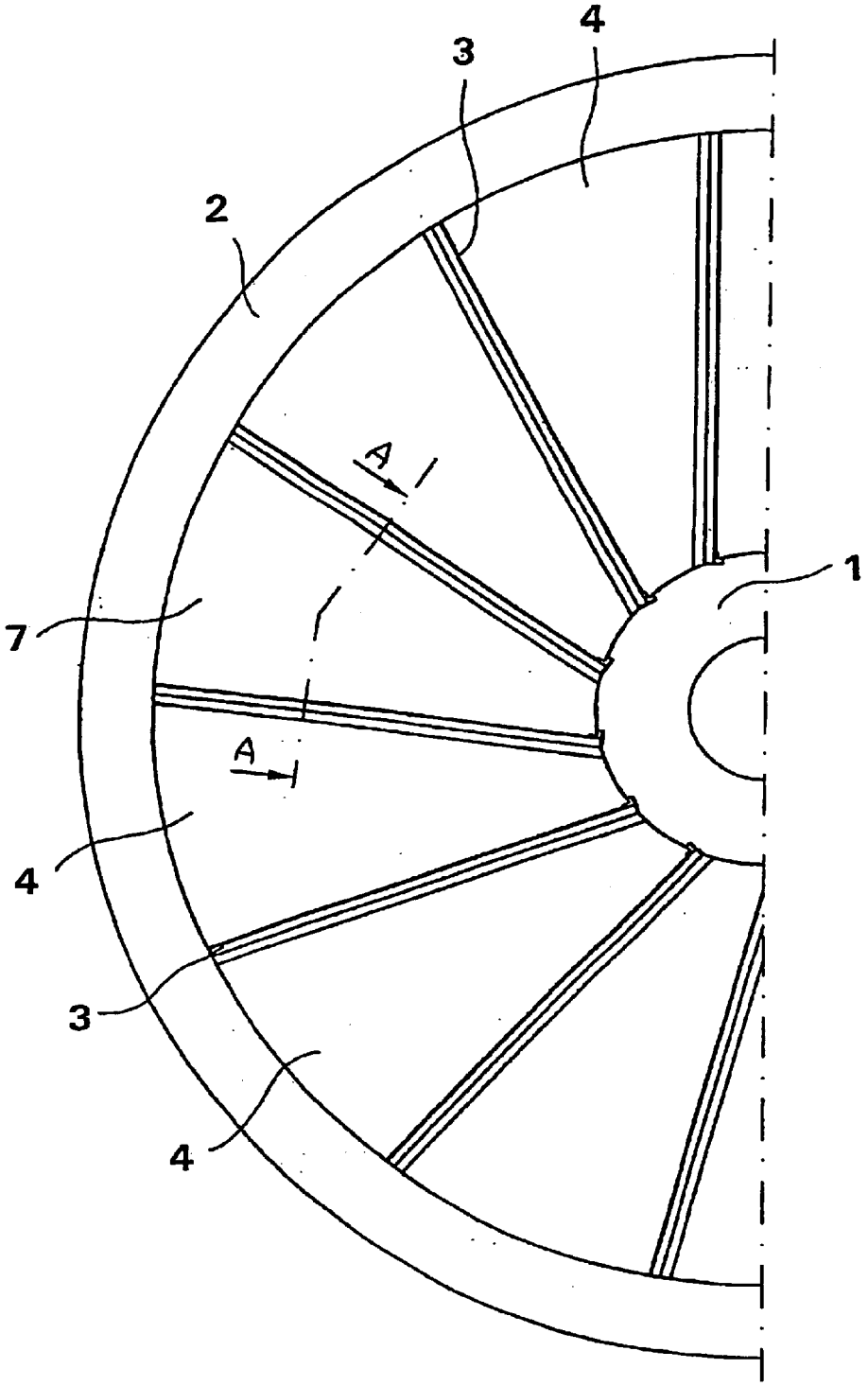
FIG. 1 shows a knife disc of a disc chipper as seen from the feed direction of logs.

In FIG. 1 is illustrated a front view of a knife disc 2 rotating on a horizontal shaft 1 in a disc chipper. Knives 3 mounted on the disc extend from the center portion of the disc toward the outer periphery of the disc. The tip edges of the knives 3 are straight and mutually aligned to run in the same plane which is orthogonal to the disc shaft 1. The knives 3 are mounted on sector-shaped wear plates 4 (FIG. 2) placed adjacent to each other. As the thickness of wear plates 4 is made slightly tapering toward their trailing edge, their wear surface is respectively inclined from the vertical plane that is perpendicular to the shaft of the disc chipper. During chipping, the wear plates 4 mounted on the rotary disc 2 are abraded by a log 6 that rests against the stationary anvil knife 5. Hence, the wear surface 7 of the wear plate is subjected to heavy wear necessitating rehardfacing of the surface by a wear-resistant coating 8.

Figure 2:
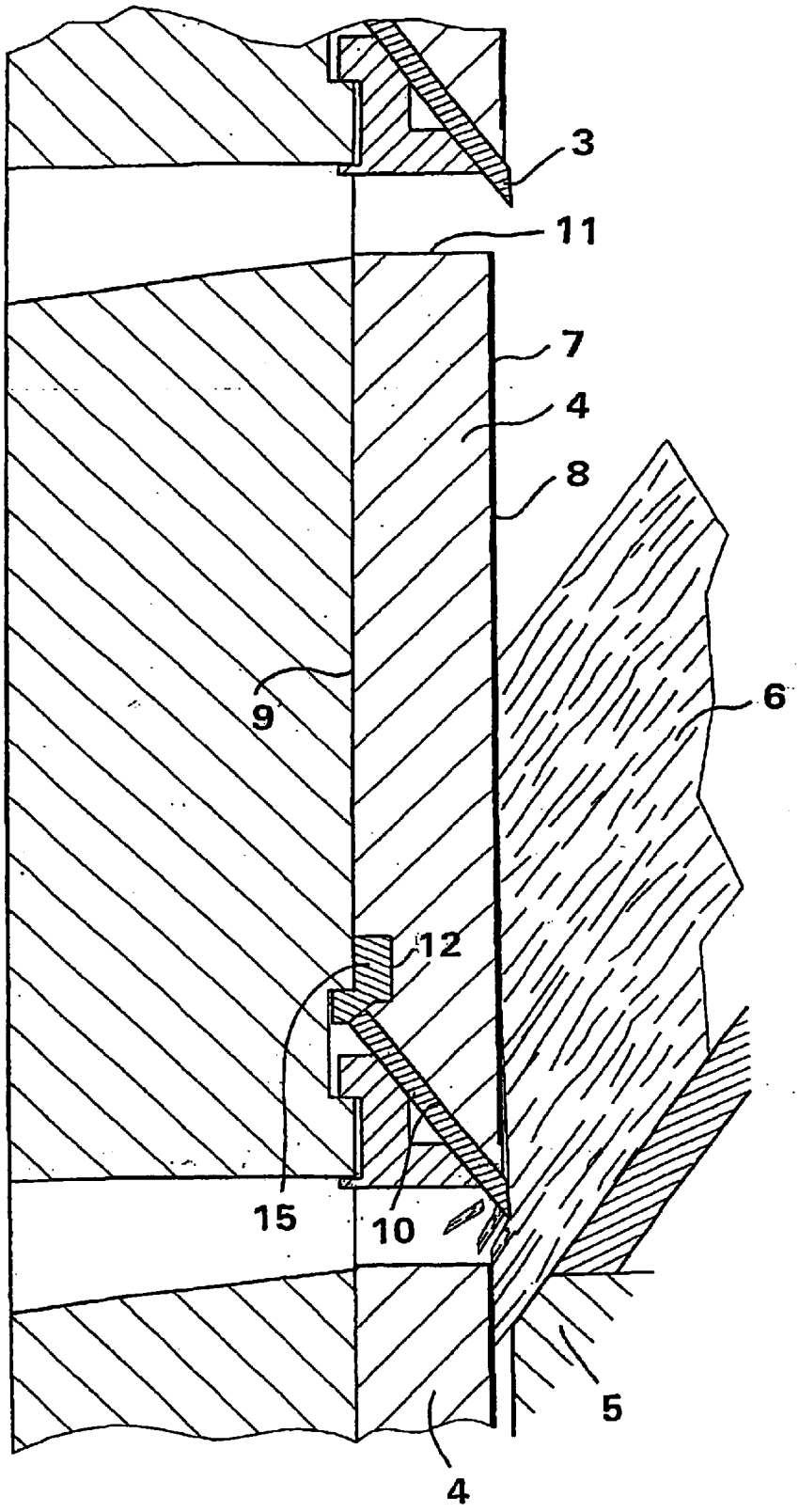
FIG. 2 shows a sectional view along plane A—A of FIG. 1 during chipping.
Figure 3:
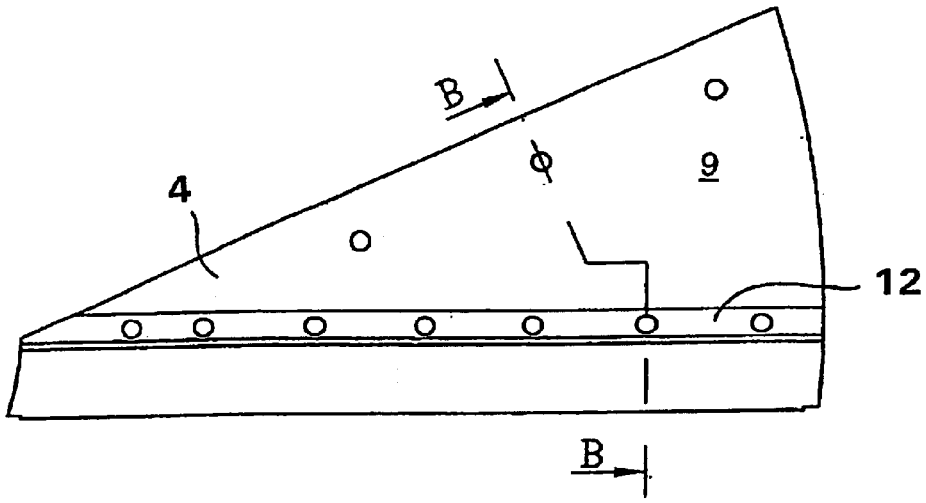
FIG. 3 shows a conventional wear plate of a disc chipper as seen from the direction of the wear plate rear side, that is, the mounting surface of the wear plate.
Figure 4:
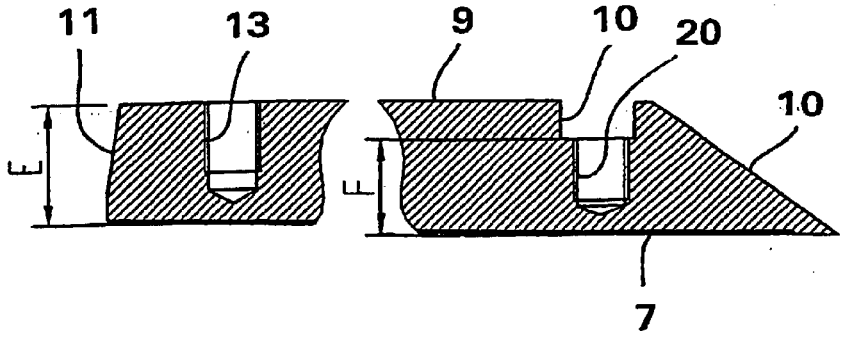
FIG. 4 shows a sectional view along plane B—B of FIG. 3.

In its manufacturing process, a blank of the wear plate is first fabricated and pulverized coating material is sprayed on its wear surface. The powder-form coating is melted by heat treatment to adhere the coating to the surface of the wear plate blank so as to provide a wear-resistant hardfacing 8. After the heat treatment step, the rear side 9 of the wear plate blank, as well as other surfaces 10, 11 thereof, are post-machined. Additionally, the rear side 9 is provided with a clamp groove 12 allowing the wear plate and the knife elements to be mounted with the help of a clamp piece 15 onto the knife disc. The clamp groove 12 is depicted in FIGS. 2, 3 and 4, while the clamp piece 15 is depicted in FIG. 2.

The rear side of the wear plate is provided with threaded blind holes 13 and 20 that are located to the peripheral areas of the sector-shaped wear plate in rows which are aligned essentially radially on the knife disc. The blind holes are threaded to accommodate bolts that are inserted through the body of the knife disc 2 for affixing the wear plates on the front side, that is, the cutting side of the knife disc. The wear plate 4 is affixed by screws to the knife disc 2 so that the entire rear side 9 of the wear disc rests against the knife disc 2.

During the heat treatment step required in the hardfacing process, the wear plate blank becomes warped or twisted so that surfaces 9 and 10 do not stay planar. Problems related to such deformations are avoided by post-machining the blank only after the heat treatment step.

However, when a wear plate is desired to be rehardfaced after the original wear surface layer is worn out, the deformations caused by the heat treatment step become problematic, since the machining allowance of the wear plate blank has already been consumed. Furthermore, prior to the deposition of the new hardfacing, the remainders of the old wear surface 8 and a certain amount of the base material must be machined away. The thickness of a new wear plate at its affixing points is, e.g., E and F, as denoted in FIG. 4. Then, the rehardfaced plate would have dimensions <E and <F at its respective points. Therefore, a wear plate to be rehardfaced is thinner than a virgin wear plate already before the post-machining step to rectify the dimensional deformations will be commenced.

Conventionally, only the most worn wear plates are replaced in a disc chipper. However, they cannot be replaced by undersize wear plates, but rather, new wear plates having virgin dimensions for replacement must be used.

Figure 5:
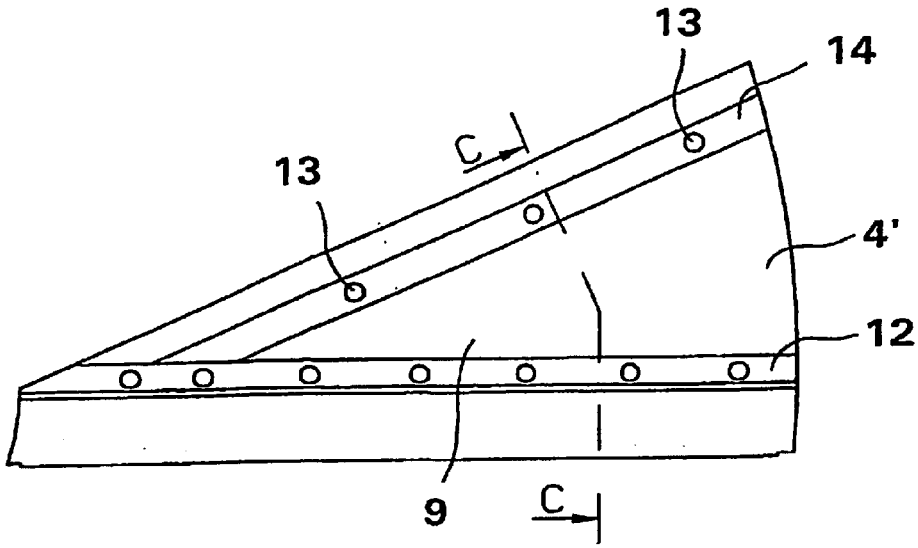
FIG. 5 shows a groove made according to the invention to the rear side of the wear plate.
Figure 6:
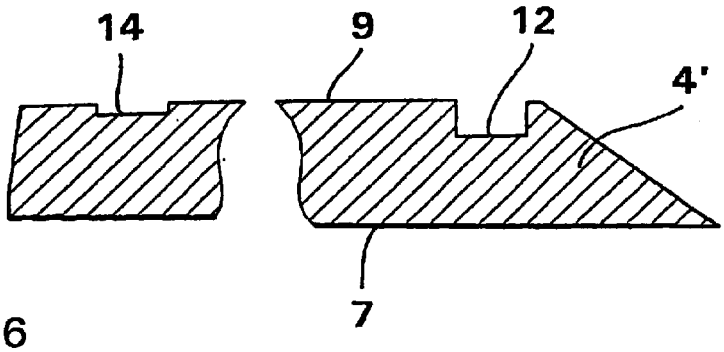
FIG. 6 shows a sectional view along plane C—C of FIG. 5.
Figure 7:
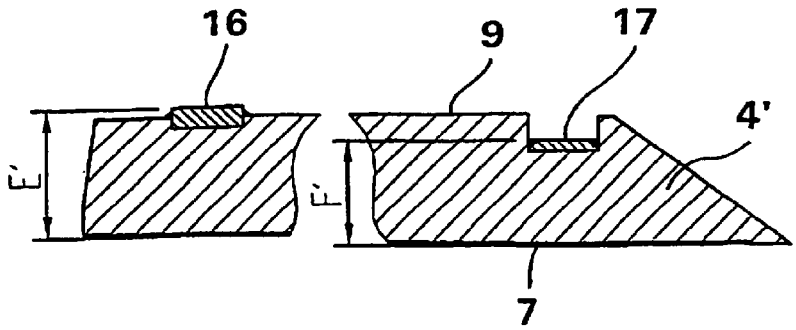
FIG. 7 shows also a sectional view along plane C—C of FIG. 5 but now with machining allowance strips inserted in the grooves.

In FIGS. 5, 6 and 7 is shown an embodiment of the method according to the invention, wherein a wear plate blank 4' is provided already during its fabrication with an additional groove 14 intended to improve the rehardfacing operation. The additional groove is made on the wear plate so as to run over the threaded holes 13 of the wear plate fixing bolts. Prior to the rehardfacing step, to the additional groove 14 and the clamp groove 12 are affixed by welding, for instance, machining allowance strips 16, 17 that offer a sufficient amount of base material for post-machining. Hence, the machining allowance strips are machined after the heat treatment step so as to make the wear plate dimensions E' and F' equal to those of a new wear plate (so that E'=E and F'=F). The rehardfaced wear plate 4' will be affixed to the knife disc 2 so that only the machined surfaces of the machining allowance strips 16, 17 of the wear plate rear side make contact to the knife disc. At the clamp groove 12, the wear plate is also supported by a clamp piece 15.

Inasmuch reconditioning may now be carried out by removing material from the machining allowance strips 16, 17 only, the present method makes the repair of a wear plate highly cost-efficient over conventional techniques wherein it has been necessary to machine the entire surface of the wear plate rear side 9.

Figure 8:
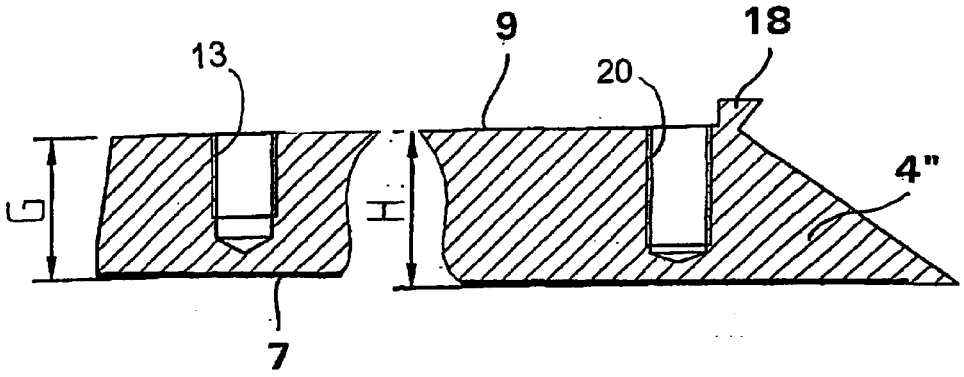
FIG. 8 shows another type of conventional wear plate of a disc chipper.
Figure 9:
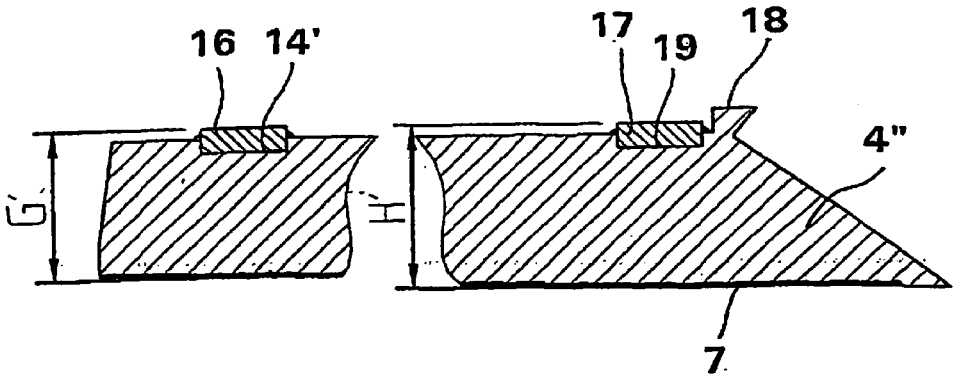
FIG. 9 shows grooves and machining allowance strips adapted according to the invention to the wear plate of FIG. 8.

In FIG. 8 is shown another type of conventionally used wear plate required in a different kind of knife disc. Herein, the clamp piece 15 is omitted and instead the wear plate 4" incorporates a ridge 18 serving to clamp the wear plate to the knife disc 2. In FIG. 9 is illustrated an application of the present invention to the repair of this kind of wear plate 4". The wear plate is provided with grooves 14', 19 into which the machining allowance strips 16 and 17 are welded during the rehardfacing operation. The machining allowance strips are machined after the heat treatment step so as to make dimension G'=G and dimension H'=H. Resultingly, the distance of the rehardfaced wear plate front side from the mounting surface of the knife disc is retained equal to that of a new wear plate.

It will be appreciated that the wear plates reconditioned in accordance with the invention are fully interchangeable with new wear plates. This makes it possible when so desired to replace only a portion of wear plates in a disc chipper with reconditioned wear plates. Moreover, the invention eliminates the double inventory of wear disks and the risk of mixing wear discs of different thickness dimensions with each other.

In any embodiment of the invention, the machining allowance strips 16 and 17 may also be affixed by screws to the wear plate thus making the next rehardfacing operation easier. In the context of the present invention, the term "strip" must be understood to include such implementations wherein the strip is comprised of a string of separate material pieces displaced at a distance from each other.

Advantageously, grooves 14, 14' and 19 are made on new wear plates already during their manufacture, but the grooves may as well be machined as an additional step during the reconditioning of existing wear plates.

What is claimed is:

1. A method for reconditioning wear plates on a mounting face of a knife disc of a disc chipper, said wear plates having a front side and a rear side that are substantially parallel to each other, a thickness determined by a distance between the front side and the rear side, the wear plate having a leading edge and a trailing edge, the edges defining a planar sector shape, the face side having a wear-resistant hardfacing adhered thereto by a heat treatment process and the rear side having made thereto both a clamp groove, which is aligned parallel to the leading edge for accommodating clamp means of a chipper knife, and a reconditioning groove aligned parallel to the trailing edge, and the wear plate being reconditioned in a process including a heat treatment, the method comprising the steps of:

affixing machining allowance strips in said clamp groove and said reconditioning groove, and machining said machining allowance strips wherein post-machining of the thickness of the wear plate after reconditioning the hardfacing is effected.

2. The method of claim 1, further comprising the step of affixing the machining allowance strips in the grooves as continuous sections.

3. The method of claim 1, further comprising the step of affixing the machining allowance strips in the grooves as separate sections.

4. A method for reconditioning wear plates used on a mounting face of a knife disc of a disc chipper, said wear plates having a face side and a rear side that are substantially parallel to each other, a thickness determined by a distance between the face side and the rear side the wear plate formed by a leading edge and a trailing edge, the edges defining a planar sector shape, the face side having a wear-resistant hardfacing adhered thereto by a heat treatment process and the rear side having a first reconditioning groove aligned parallel to the leading edge and a second reconditioning groove aligned parallel to the trailing edge, the wear plate hardfacing being reconditioned in a process including a heat treatment, the method comprising the steps of:

affixing machining allowance strips in said first and second reconditioning grooves; and machining said machining allowance strips wherein post-machining of the thickness of the wear plate after reconditioning is effected.

5. The method of claim 4, further comprising the step of affixing the machining allowance strips in the reconditioning grooves as continuous sections.

6. The method of claim 4, further comprising the steps of affixing the machining allowance strips in the reconditioning grooves as separate sections.

7. A disc chipper wear plate reconditioned using the method of claim 1.

8. A disc chipper wear plate reconditioned using the method of claim 2.

9. A disc chipper wear plate reconditioned using the method of claim 3.

10. A disc chipper wear plate reconditioned using the method of claim 4.

11. A disc chipper wear plate reconditioned using the method of claim 5.

12. A disc chipper wear plate reconditioned using the method of claim 6.

* * * * *